US005685805A

United States Patent [19]

Peritz

[11] Patent Number: 5,685,805

[45] Date of Patent: Nov. 11, 1997

[54] EXERCISE DEVICE

[76] Inventor: Mark Peritz, P.O. Box 503, Woodstock, N.Y. 12498

[21] Appl. No.: 586,107

[22] Filed: Jan. 16, 1996

[51] Int. Cl.[6] ..... A63B 22/12

[52] U.S. Cl. ..... 482/62

[58] Field of Search ..... 482/62, 57, 52, 482/56, 79, 53

[56] References Cited

U.S. PATENT DOCUMENTS

| | | | |
|---|---|---|---|
| 3,423,086 | 1/1969 | Moore | 280/289 |
| 4,112,807 | 9/1978 | Quibell | 84/411 |
| 4,257,588 | 3/1981 | Ketchman | 482/62 |
| 4,569,401 | 2/1986 | Luck | 272/73 |
| 4,674,390 | 6/1987 | Allen et al. | 84/419 |
| 4,705,269 | 11/1987 | De Boer et al. | 482/62 |
| 4,981,243 | 1/1991 | Rogowski | 224/41 |
| 5,330,402 | 7/1994 | Johnson | 482/62 |

OTHER PUBLICATIONS

Kat–Katalog–Kat Controllers brochure 1993. Katalog–Kat Incorporated 1993.

*Primary Examiner*—Stephen R. Crow

[57] ABSTRACT

An exercise device which combines an exercise bicycle with a percussion instrument, preferable an electronic percussion pad, to provide amusement to the exerciser while also providing exercise to the upper portion of the body and improving coordination between the movement of the arms and the legs.

1 Claim, 3 Drawing Sheets

EXERCISE DEVICE

FIELD OF THE INVENTION

The present invention relates to an exercise device as used in health maintenance programs and, more particularly, to an exercise device including an exercise bicycle with a percussion instrument to provide entertainment to the exerciser while also providing low-impact exercise to the upper body while improving coordination between the arms and the legs of the exerciser.

BACKGROUND OF THE INVENTION

It is well known that bicycle riding is an excellent form of exercise, particularly for the lower body. Riding outside frequently is not feasible due to traffic conditions, weather and many other possible reasons. Platform or stationary bicycles are well known and readily available. The major cause of exercisers not continuing with their exercise program with an exercise bicycle or other equipment is that boredom overwhelms them during the exercise period. Furthermore, an exercise bicycle does not provide any use of the upper body and does not develop the much needed coordination between the arms and the legs.

One proposed device using an exercise bicycle is taught in the Luck Patent, U.S. Pat. No. 4,569,401 which incorporates an exercise bicycle in a frame with a boxing bag and a chest rest which permits the exerciser to punch the punching bag while peddling the bicycle. Without doubt, this device provides an exercise bicycle which provides substantial upper body exercise and develops coordination between the arms and the legs, but does not avoid the boredom so fatal to the exerciser interested in health maintenance rather than being a professional athlete.

There is a need for an exercise device which provides low-impact exercise of the upper body and exercise of the lower body while at the same time providing enjoyment to the exerciser and develops coordination between the arms and the legs.

SUMMARY OF THE INVENTION

The principal object of this invention is to provide an exercise device which provides for development of the upper and lower body while providing diversion to eliminate boredom while also developing coordination.

Another object is to provide an exercise device which can be used without disturbing others in the vicinity of the exercise device.

Another object is to provide an exercise device which is economical and convenient to use.

These and other useful objects are achieved by mounting a percussion instrument in place of the handle bars of an exercise bicycle in proper position for striking such instrument with a mallet or the hands while operating the pedals of a bicycle with the exerciser's legs. Preferably. an electronic percussion pad would be used which produces a wide variety of sounds pleasing to the tastes of many people. Preferably, a head set or head phones are further provided in combination with the percussion instrument to permit use without the sounds produced being of annoyance to others in range of hearing.

DESCRIPTION OF THE PREFERRED EMBODIMENT OF THE INVENTION

Figure 1:
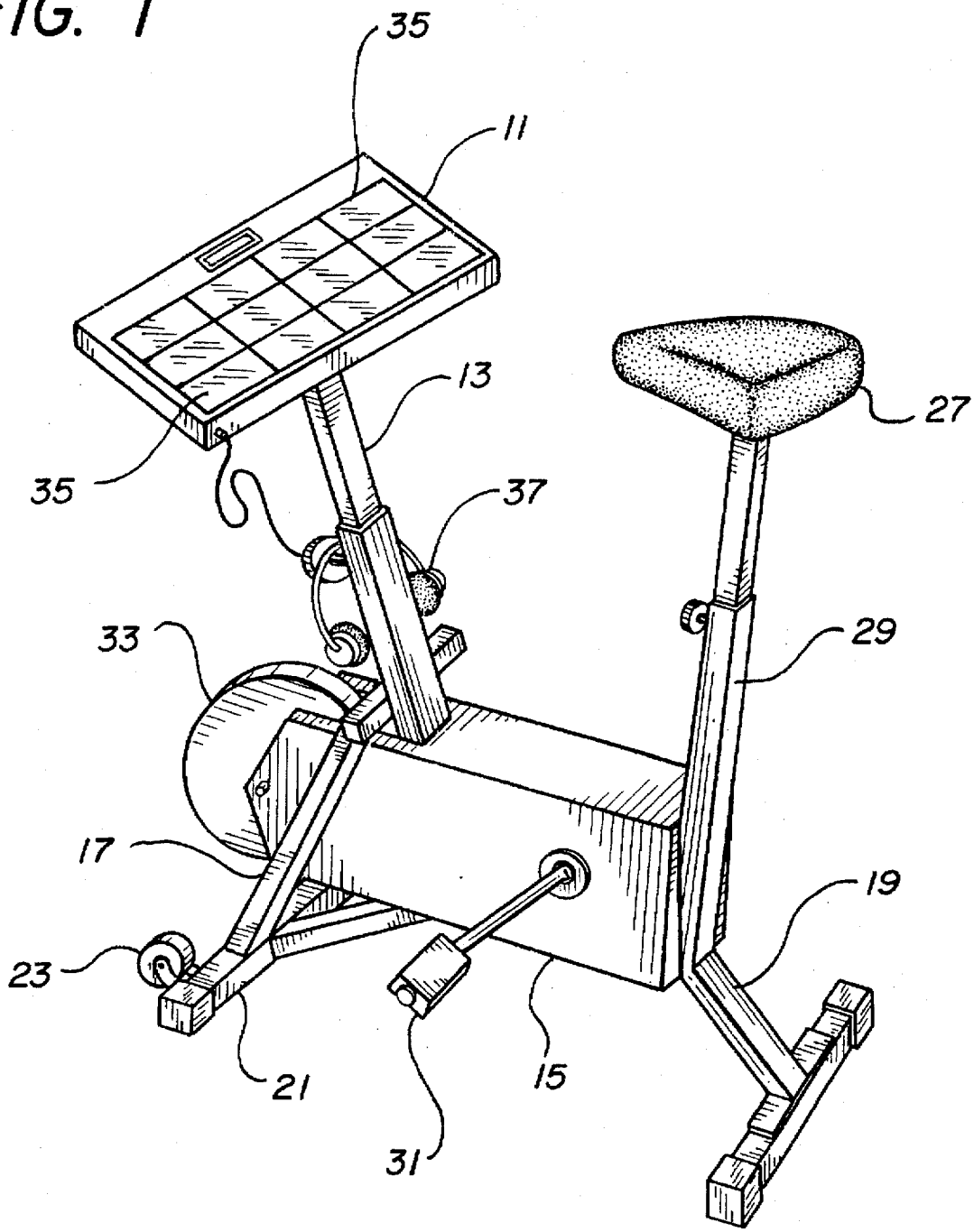
FIG. 1 is a perspective view of the exercise bicycle showing an electronic percussion pad mounted on the handle bar support column and with a head set for listening to the sounds produced on the percussion pad of the percussion instrument mounted on the handle bar support column of the exercise bicycle.

Referring now to FIG. 1, the exercise device is shown with a percussion pad 11 mounted on the handle bar support column 13 of an exercise bicycle frequently referred to as a stationary bicycle 15. The exercise bicycle 15 includes a frame 17 on which the handle bar support column 13 is mounted. The frame 17 includes a rear support 19 and a front support 21. On the front support 21, a pair of wheels 23 are mounted for convenience in moving the exercise device.

Figure 2:
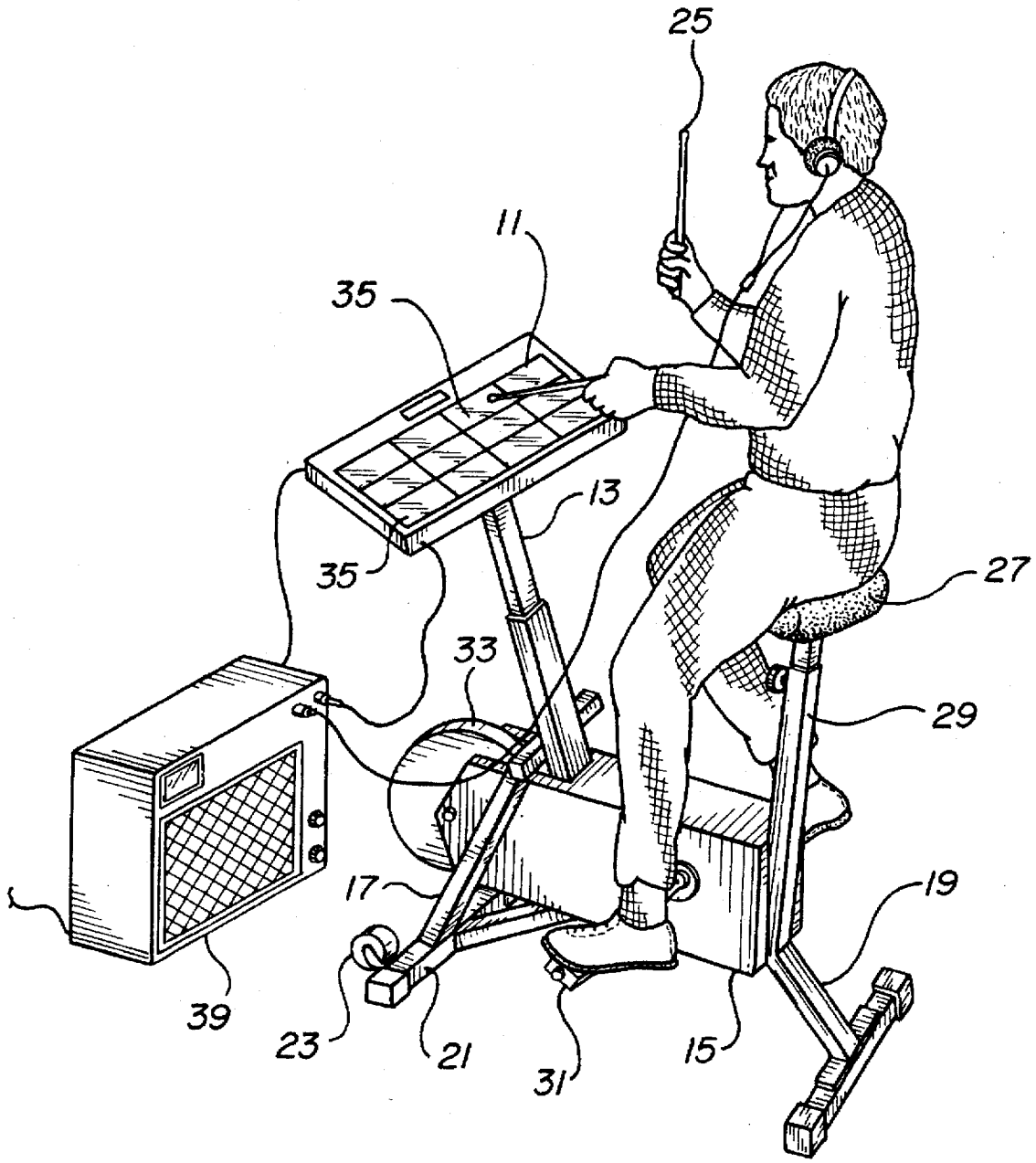
FIG. 2 is a perspective view of an exercise bicycle showing an exerciser sitting on the seat of an exercise bicycle with mallets in hand playing the percussion instrument and wearing a head set and also showing an amplifier on the floor next to the exercise bicycle and connected to the percussion pad and the head set.

The percussion pad 11 may be mounted on the handle bar support column 13 in any convenient manner but a plate (not shown) affixed to the top of the handle bar support column 13 which permits attachment by screws or bolts at any suitable point on the bottom of the percussion pad 11. As best seen in FIG. 2, the handle bar support column 13 is preferable adjustable so that the percussion pad 11 can be located at a height convenient for the exerciser to reach with mallets 25 while sitting in a proper position for use of the peddles 31 of the exercise bicycle 15 with the exerciser's legs.

The exercise bicycle 15 has a seat 27 mounted on a seat column 29 which seat column 29 is also adjustable as to height. The exercise bicycle 15, numerous varieties of which are commercially available, has peddles 31 for rotation by the exerciser with the exerciser's legs. A chain drive (not shown) is operated by the peddles 31 to rotate a flywheel 33 which provides smooth operation of the rotation of the peddles of the exercise bicycle.

As best seen in FIG. 2, as the exerciser peddles the exercise bicycle 15, the exerciser also uses the upper body to strike the percussion pad 11. The striking of the percussion pad 11 produces a specific note and any one of many types of sounds. For example, the exerciser may select the sounds of a piano and the point of striking will determine which note of a piano sound will be heard. In this way, the exerciser strives to coordinate the movement of the arms to produce the musical sounds desired while also coordinating that motion with movement of the legs. Percussion pads 11 are available commercially and can produce hundreds of different sounds including the sounds of keyboard, strings as well as numerous percussion instruments. Percussion pads 11 have segregated areas 35 which produce different notes and the selection of the proper area 35 produces the desired sound. As seen in FIG. 2, the exerciser is wearing a head set 37 which permits the exerciser to hear the product of his hand and arm movements using the hands or the mallets 25 shown held in the hands of the exerciser. The percussion pad 11 in FIG. 2, is shown connected to an amplifier 39 but it is possible to include the amplifier 39 as a part of the base of the percussion pad 11. By use of the head set 37, the sounds produced cannot be heard by others in the vicinity. This permits the exercise device to be desirable for use in a gym with a multiplicity of such devices in use at the same time without any one exerciser interfering with another exerciser using another exercise device or others in the gym using different equipment.

Figure 3:
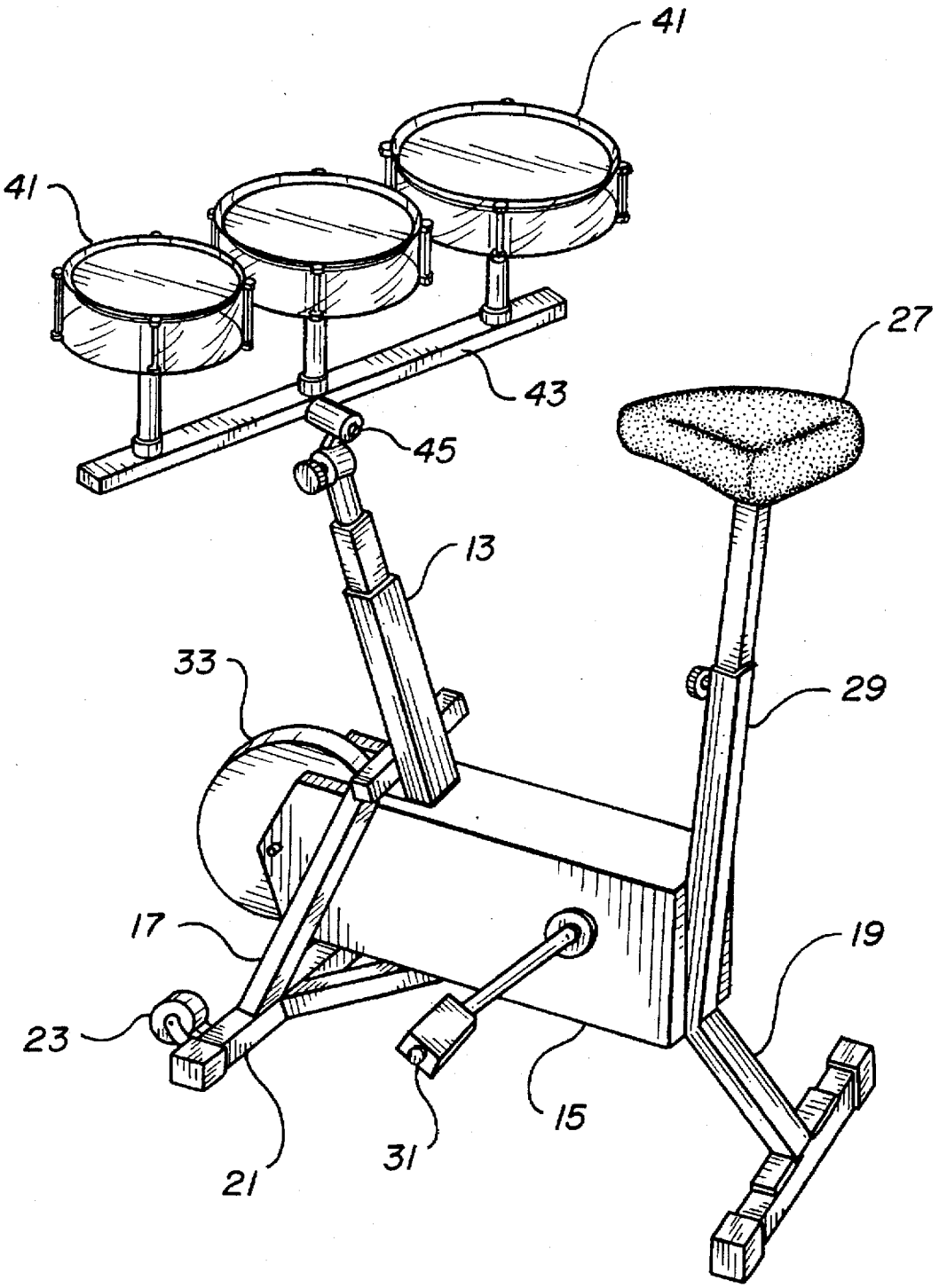
FIG. 3 is a perspective view of the exercise device showing a series of three tom-toms mounted on the handle bar support column of an exercise bicycle for striking by hand or with a mallet held by the hands to produce percussion sounds while operating the peddles of the exercise bicycle with the exerciser's legs.

Now referring to FIG. 3, The same exercise device is shown but in a more basic and alternate design of the exercise device. The exercise bicycle 15 is used in the same manner as previously described. However, in place of the percussion pad 11, a series of tom-toms 41 are secured to a mounting bar 41 mounted on the handle bar support column 13. The mounting bar 43 is mounted on the handle bar support column 13 by a pair of swivel joints 45 at right angles to one another to permit adjustment of the angle of the mounting bar and thus the angle of the tom-toms. This exercise device does not provide the quiet operation of the embodiment shown in FIGS. 1 and 2 and does not permit the production of a wide variety of sounds but does permit the production of percussion sounds and requires arm and hand coordination with the movement of the legs and does also provide sufficient diversion to avoid boredom from exercising. The tom-toms 41 shown are but one variety of percussion instruments which can be mounted in the same or a similar manner on the handle bar support column 13 of the exercise bicycle 15. Other possible instruments for mounting on the handle bar support column 13 include tubular bells, xylophones and a wide variety of drums. One advantage in the use of the instruments in accordance with the embodiment shown in FIG. 3, is the substantially reduced cost for home use.

Thus while preferred embodiments of the invention have been shown and described, it will be apparent to those skilled in the art that many other changes and modifications may be made with out departing from the invention in its broader aspects. The appended claims are therefore intended to cover all such changes and modifications as fall within the true spirit and scope of the invention.

I claim:

1. An exercise device for lower body development and upper body development, the upper body development providing entertainment, said exercise device, in combination, comprising:

a front support a front fork head tube and a rear support;

pedals for rotation to provide lower body development;

a chain drive connecting the pedals to the flywheel;

an adjustable handle bar support column telescopically positioned within said head tube;

an adjustable seat column;

a percussion pad non-removably mounted on the adjustable handle bar support column, the percussion pad having segregated areas which produce different notes;

an amplifier; and a headset connected to the amplifier, the percussion pad being struck during use of the pedals to provide both upper body development and entertainment by means of the headset.

* * * * *